US009423137B2

(12) United States Patent
Nickolaus

(10) Patent No.: US 9,423,137 B2
(45) Date of Patent: Aug. 23, 2016

(54) FUEL INJECTOR WITH FIRST AND SECOND CONVERGING FUEL-AIR PASSAGES

(75) Inventor: Dan Nickolaus, Plainfield, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 1268 days.

(21) Appl. No.: 13/339,710

(22) Filed: Dec. 29, 2011

(65) Prior Publication Data

US 2013/0167544 A1 Jul. 4, 2013

(51) Int. Cl.
*F23R 3/30* (2006.01)
*F23R 3/28* (2006.01)

(52) U.S. Cl.
CPC ..... *F23R 3/30* (2013.01); *F23R 3/286* (2013.01); *F23D 2900/11101* (2013.01)

(58) Field of Classification Search
CPC ..... F23R 3/286; F23R 3/30; F23R 3/14; F23R 3/343; F23D 2900/11101; F02C 7/22
USPC ..... 60/740, 742, 748
See application file for complete search history.

(56) References Cited

U.S. PATENT DOCUMENTS 3,866,413 A 2/1975 Sturgess
4,365,753 A 12/1982 Harding et al.
4,653,278 A * 3/1987 Vinson et al. ..... 60/737
5,417,070 A * 5/1995 Richardson ..... 60/748
5,505,045 A * 4/1996 Lee ..... F23D 11/107 239/424
5,647,538 A * 7/1997 Richardson ..... F23D 11/101 239/405
5,987,889 A * 11/1999 Graves ..... F23C 7/004 60/746
6,068,470 A * 5/2000 Zarzalis ..... F23D 11/007 239/403
6,189,314 B1 * 2/2001 Yamamoto et al. ..... 60/776
6,244,051 B1 * 6/2001 Zarzalis et al. ..... 60/743
6,272,840 B1 8/2001 Crocker et al.
6,345,505 B1 * 2/2002 Green ..... F23R 3/343 239/406
6,389,815 B1 * 5/2002 Hura et al. ..... 60/746
6,715,292 B1 4/2004 Hoke
6,764,302 B2 * 7/2004 Eberspach et al. ..... 431/354
6,799,427 B2 * 10/2004 Calvez ..... F23R 3/14 60/737
6,883,730 B2 4/2005 Eberspach et al.
7,266,945 B2 9/2007 Sanders
7,434,401 B2 10/2008 Hayashi
7,942,003 B2 5/2011 Baudoin et al.
2005/0097889 A1 * 5/2005 Pilatis ..... F23D 11/107 60/743
2005/0241319 A1 * 11/2005 Graves et al. ..... 60/776
2006/0021350 A1 * 2/2006 Sanders ..... 60/743
2007/0137207 A1 6/2007 Mancini et al.
2007/0289306 A1 12/2007 Suria et al.

(Continued)

OTHER PUBLICATIONS

International Search Report and Written Opinion dated May 8, 2013 for PCT/US2012/072163, Rolls-Royce Corporation (12 pages).

*Primary Examiner* — Carlos A Rivera
(74) *Attorney, Agent, or Firm* — Brinks Gilson & Lione

(57) ABSTRACT

A gas turbine engine fuel injector is disclosed having a plurality of fuel injection circuits that are structured to deliver fuel to air passageways. In one non-limiting embodiment, one of the fuel injection circuits includes a plain jet airblast injector that delivers fuel to an air passageway. In some applications the plain jet can extend across the air passageway and deliver a fuel to an opposite surface to form a fuel film. The fuel film can then be sheared between an air in the air passageway and an air in a nearby air passageway. Another of the fuel injection circuits includes a fuel filmer structured to deliver fuel to an air passageway that can then be sheared by an air in the air passageway and an air in the air passageway that included the plain jet airblast injector.

21 Claims, 2 Drawing Sheets

(56) References Cited

U.S. PATENT DOCUMENTS

2008/0289340 A1* 11/2008 Oda et al. ..... 60/737
2009/0100837 A1* 4/2009 Von Der Bank ..... 60/737
2009/0113893 A1* 5/2009 Li et al. ..... 60/737
2010/0308135 A1* 12/2010 Yamamoto et al. ..... 239/402

* cited by examiner

FUEL INJECTOR WITH FIRST AND SECOND CONVERGING FUEL-AIR PASSAGES

TECHNICAL FIELD

The present invention generally relates to devices for delivering fuel, and more particularly, but not exclusively, to fuel injectors for gas turbine engines.

BACKGROUND

Providing a fuel/air mixture to a combustor of an internal combustion engine remains an area of interest. Some existing systems have various shortcomings relative to certain applications. Accordingly, there remains a need for further contributions in this area of technology.

SUMMARY

One embodiment of the present invention is a unique fuel injector. Other embodiments include apparatuses, systems, devices, hardware, methods, and combinations for mixing fuel and air. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
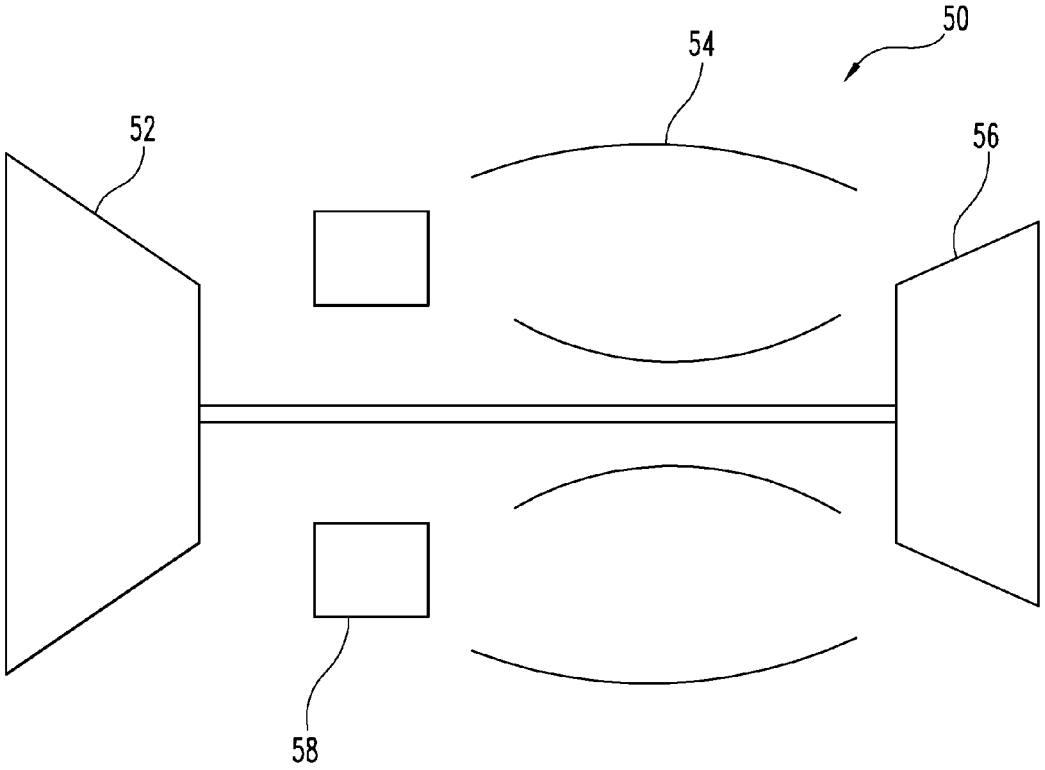
FIG. 1 depicts one embodiment of a gas turbine engine.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, a gas turbine engine 50 is disclosed that includes a compressor 52, combustor 54, and turbine 56. As air enters the gas turbine engine it is compressed by the compressor 52 and mixed with a fuel delivered by a fuel injector 58. The fuel injector 58 can be located a variety of places within the gas turbine engine and is not limited to the location depicted in FIG. 1. The fuel/air mixture is combusted in the combustor 54 before being delivered to the turbine 56. As used herein, the term "air" refers to any oxidizer suitable for use with a fuel that is to be combusted in the combustor 54, whether or not the oxidizer takes the form of atmospheric air. Similarly, the fuel can take a variety of forms suitable for use in gas turbine engines.

Though the gas turbine engine 50 is depicted as having a single compressor and single turbine, in other embodiments the gas turbine engine 50 can have any number of compressors and turbines. In addition, the gas turbine engine 50 can have any number of shafts coupling the compressors and turbines to create separate spools. In a few non-limiting examples of embodiments, the gas turbine engine 50 can take the form of a turboshaft, turboprop, or turbofan engine. In addition, the gas turbine engine 50 can be an adaptive or variable cycle engine. The gas turbine engine 50 can also be an axial flow engine, centrifugal flow engine, or a hybrid of each. In short, the gas turbine engine 50 and/or its individual components can take on a variety of forms and be used in a variety of applications.

In some applications the gas turbine engine 50 can be used as a powerplant for an aircraft. As used herein, the term "aircraft" includes, but is not limited to, helicopters, airplanes, unmanned space vehicles, fixed wing vehicles, variable wing vehicles, rotary wing vehicles, unmanned combat aerial vehicles, tailless aircraft, hover crafts, and other airborne and/or extraterrestrial (spacecraft) vehicles. Further, the present inventions are contemplated for utilization in other applications that may not be coupled with an aircraft such as, for example, industrial applications, power generation, pumping sets, naval propulsion, weapon systems, security systems, perimeter defense/security systems, and the like known to one of ordinary skill in the art.

Figure 2:
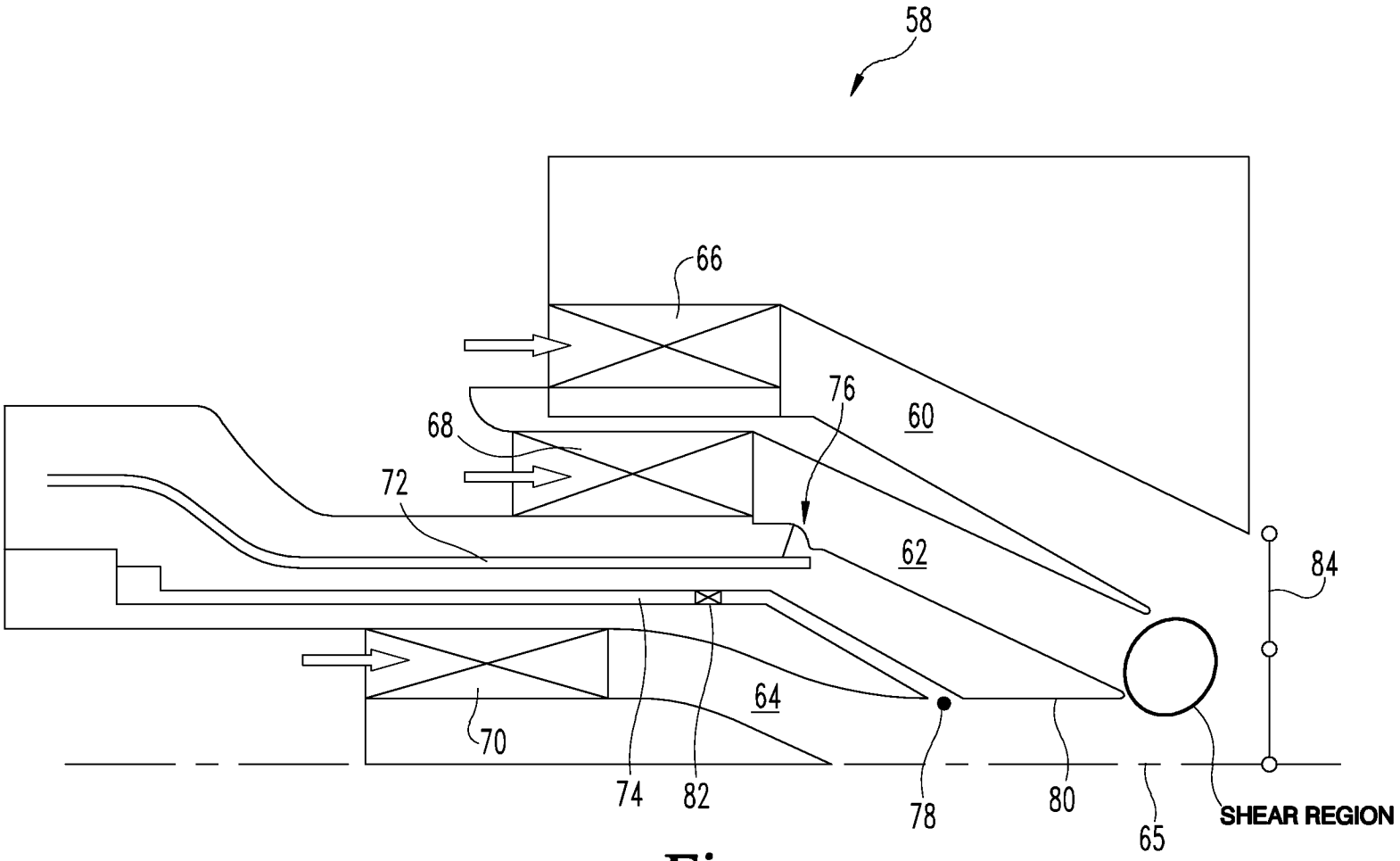
FIG. 2 depicts one embodiment of a fuel injector.

Turning now to FIG. 2, a view of one embodiment of the fuel injector 58 is shown. The fuel injector 58 is used to atomize liquid fuel and mix the fuel with an air stream before being combusted in the combustor 54. In one form the fuel injector 58 can be used to provide fuel to a lean burning combustor 54 of the gas turbine engine 50. Generally speaking, the rate of vaporization of a liquid fuel can be enhanced by increasing the total surface area of the liquid fuel in relation to the mass of fuel. For example, by forming the liquid fuel into droplets or forms other than a bulk liquid the rate of vaporization can be increased. Such increase in the surface area relative to its mass can be made possible by atomizing the fuel using a variety of approaches. The plain jet airblast atomizer and fuel filming are two such approaches, but by no means the only approaches. The fuel injector 58 of the present application uses both plain jet airblast and fuel filming in some embodiments as will be described further below, but the injector 58 is not limited to these particular approaches.

In the illustrated form the fuel injector 58 includes passageways 60, 62, and 64 which are used to convey air to be mixed with fuel and eventually combusted. The passageways 60, 62, and 64 are annular passageways arranged about a reference line 65 of the injector. Though only three passageways 60, 62, and 64 are shown in the illustrated embodiment, other embodiments can include additional passageways. The passageways 60, 62, and 64 are arranged to admit air at an upstream side and discharge the air at a downstream side and in general can have a variety of shapes and orientations in any given embodiment. In the illustrated form the passageways each include a portion that directs air from a radially outer location and toward the reference line 65. The passageways 60, 62, and 64 can have a variety of lengths and are offset from each other, as shown for example in the illustrated embodiment. In addition, the passageways 60, 62, and 64 can have a variety of cross sectional areas, including a variety of areas that are different across the passageways. In some forms the passageways 60, 62, and 64 can have a cross sectional area that decreases along its length which can be used to accelerate the flow therein. The inlets and outlets of the passageways 60, 62, and 64 can be located at a variety of axial locations. As can be seen in the illustrated embodiment, the inlets and outlets are axially offset from one another. In some forms, however, two or more of the inlets and/or outlets can have the same axial location.

In the illustrated embodiment the airflow passing through the passageways 60, 62, and 64 is influenced by action of swirlers 66, 68, and 70, respectively. The swirlers 66, 68, and 70 are used to impart a rotational component to the airflow in the passageways 60, 62, and 64. Any of the swirlers 66, 68, and 70, or portions thereof, can be disposed within the passageways 60, 62, and 64. In addition, the swirlers 66, 68, and 70 can be external to the passageways 60, 62, and 64 and structured to deliver air to the passageways. Many different types of swirlers can be used such as, but not limited to, vane type swirlers and swirlers formed of a plurality of discrete air passages arranged at an angle relative to the direction of incoming airflow. The swirlers can be arranged circumferentially around the injector 58. In some forms of the injector 58 one or more of the swirlers 66, 68, and 70 can be different from the others.

In one embodiment the fuel injector 58 includes an outer fuel conduit 72 and an inner fuel conduit 74. The outer fuel conduit 72 is arranged to deliver fuel to the passageway 62 through an outer aperture 76. The outer aperture 76 can be located downstream of the swirler 68 as shown in the illustrated embodiment, but in other forms the outer aperture 76 can be located to deliver fuel at the location of the swirler 68. The fuel in the outer fuel conduit 72 can be pressurized to a variety of pressures by a fuel pump (not shown) or other suitable device and can be delivered through the outer aperture 76 at a variety of flow rates and temperatures. The outer aperture 76 can take a variety of forms including, but not limited to, a hole or a slot. In addition, multiple outer apertures 76 can be used to deliver fuel to the passageway 62. In some non-limiting embodiments the outer fuel conduit 72 and outer aperture 76 can be operated to provide a plain jet injector to the passageway 62.

The outer fuel conduit 72 and/or outer aperture 76 can be used to provide a fuel jet at a variety of angles relative to the surface of the passageway 62 in which fuel is injected. During operation, air is used to strip fuel from the fuel jet to create ligaments or droplets of fuel of varying sizes and shapes. Such action serves to spread fuel radially, circumferentially, or a combination of the two in the passageway 62. In some instances the fuel jet can be entirely atomized before reaching an opposite surface of the passageway 62. In other instances, however, the jet can reach across the passageway 62 and contact the opposite surface in which instance a film of fuel can be formed when the fuel adheres to the opposite surface. Such a film can be encouraged to flow downstream by an air passing through the passageway 62 where some of the fuel can be atomized. The fuel reaching the end of the passageway can be further atomized when it is sheared between the air converging from passageway 62 and passageway 60.

The embodiment depicted in FIG. 2 shows the plain jet exiting the outer aperture 76 on a radially inner surface of the passageway 62. Some forms of the fuel injector 58, however, can arrange for fuel to enter the passageway 62 at other locations, such as, but not limited to, through an exit aperture formed on the radially outer wall of the passageway 60. The description herein regarding the injection of fuel into the passageway 60 is therefore not limited to fuel exiting on a radially inner surface of the passageway 60.

The inner fuel conduit 74 is arranged to deliver fuel to the passageway 64 through an inner aperture 78. The fuel in the inner fuel conduit 74 can be pressurized to a variety of pressures by a fuel pump (not shown) or other suitable device and can be delivered through the inner aperture 78 at a variety of flow rates and temperatures. The inner aperture 78 can take a variety of forms including, but not limited to, a hole or a slot. In addition, multiple inner apertures 78 can be used to deliver fuel to the passageway 64. In some forms the inner fuel conduit 74 and inner aperture 78 can be operated to provide a film of fuel to the passageway 62.

When operated as a fuel filmer, the inner fuel conduit 74 can provide fuel to a fuel filming surface 80 downstream of the inner aperture 78. The fuel film can then be conveyed downstream, and some fuel can be atomized in the process, by an air passing from the passageway 64. The fuel reaching the end of the fuel filming surface 80 can then be atomized, either additionally or alternatively to any atomization that has already occurred, when the fuel film is sheared between the air converging from passageway 62 and air from passageway 60 that has traversed along the fuel filming surface.

In one embodiment the fuel injector 58 can include a fuel swirler 82 to impart a rotational component to a fuel flowing through the inner fuel conduit 74. The fuel swirler 82 can be positioned at a variety of locations within the inner fuel conduit 74 and can take on a variety of forms. In one non-limiting example the fuel swirler can include a plurality of angled slots of any of various number, dimensions, and angles.

The fuel injector includes a throat which in the illustrative embodiment is depicted as reference numeral 84. It will be understood that the throat 84 in FIG. 2 merely depicts the upper half of a throat of a fuel injector 58 that is symmetric about the reference line 65. Not all forms of the fuel injector 58, however, need be symmetric about the reference line 65. Each of the passageways 60, 62, and 64 are arranged to be merged upstream of the throat 84, but in some embodiments one or more of the passageways 60, 62, and 64 can be arranged to terminate at the throat 84.

In one form of operation the outer fuel conduit 72 is used as part of a main fuel injector circuit and the inner fuel conduit 74 is used as part of a pilot fuel injector circuit. However, not all embodiments of the fuel injector 58 are so limited. In particular, though the terms main fuel injector circuit and pilot fuel injector circuit can be used to describe either of the fuel conduits, no limitation is hereby intended as to whether the particular fuel circuit is to function only as a pilot or as a main in every embodiment of the fuel injector 58.

Furthermore, the gas turbine engine 50 can include other injectors 58, or the injector 58 can have other variations not explicitly disclosed herein. For example, in one non-limiting form the injector 58 can include additional openings for the delivery of fuel and/or the introduction of air.

One aspect of the present application provides an apparatus comprising a gas turbine engine having a fuel injector including a first fuel circuit for delivering fuel to a first air passage and a second fuel circuit for delivering fuel to a second air passage, the first fuel circuit structured to deliver fuel transverse to an airflow passing through the first air passage and the second fuel circuit including a fuel filmer structured to deliver fuel to a shear region of the fuel injector defined by the airflow from the first air passage and an airflow from the second air passage.

One feature of the present application provides wherein the first fuel circuit includes a plain jet injector, and wherein a side of the first air passage that includes a discharge opening of the plain jet injector extends to the shear region of the fuel injector, the shear region defined by a convergence of the first air passage and the second air passage.

Another feature of the present application provides wherein the first air passage includes a first air swirler and a second air passage includes a second air swirler.

Still another feature of the present application includes a third air passage having a third air swirler located radially outward of the second air swirler, the third air passage merging with the second air passage downstream of the plain jet injector.

Still yet another feature of the present application provides wherein the first fuel circuit is a main fuel circuit and the second fuel circuit is a pilot circuit.

A still further feature of the present application provides wherein the fuel injector of the gas turbine engine is operable to produce a film of fuel on a surface of the first air passage opposite the plain jet injector, the surface of the first air passage terminating at a convergence of the first air passage and a third air passage having a third air swirler.

Still yet a further feature of the present application provides wherein the second fuel circuit includes an opening structured to deliver fuel to a filming surface of the second air passage, the second fuel circuit including a fuel swirler upstream of the opening.

Yet still a further feature of the present application provides wherein the first fuel circuit includes a plain jet injector structured to deliver fuel in a direction away from the second fuel circuit and toward an air passage that includes a third air swirler.

Another aspect of the present application provides an apparatus comprising a gas turbine engine fuel injector including a plain jet injector structured to deliver fuel transverse to a first air passage and a fuel filmer disposed in a second air passage, the first air passage adjacent the second air passage wherein the fuel filmer is structured to deliver fuel to a confluence of the first air passage and the second air passage.

A feature of the present application provides the first air passage located radially outward of the second air passage.

Another feature of the present application includes a first swirler structured to impart a swirl to an airstream traversing the first air passage, and a second swirler structured to impart a swirl to an airstream traversing the second air passage.

Yet another feature of the present application provides wherein the plain jet injector is positioned downstream of the first swirler.

Yet still another feature of the present application provides wherein the plain jet injector is operable to deliver a liquid fuel to a surface of the first air passage opposite the plain jet injector, the liquid fuel delivered to the surface forming a film of fuel.

Still yet another feature of the present application includes a third air passage having a third air swirler, the liquid fuel conveyed to a convergence of the first air passage and the third air passage.

A further feature of the present application provides wherein the gas turbine engine fuel injector is coupled with a gas turbine engine and is structured to deliver fuel to a combustor of the gas turbine engine.

A still further feature of the present application includes a main fuel circuit having the plain jet injector and a pilot fuel circuit having the fuel filmer.

A further aspect of the present application provides an apparatus comprising a gas turbine engine having a combustor and a fuel injector structured to deliver fuel to the combustor, the fuel injector having a first fuel opening operable to deliver fuel to a first air passage and a second fuel opening operable to deliver fuel to a second air passage, and means for mixing fuel delivered through the first fuel opening with fuel delivered through the second fuel opening.

A feature of the present application includes means for intermixing a fuel film in the first air passage with an air traversing a third air passage.

Yet still a further aspect of the present application provides a method comprising providing a first fuel to a first air passage through a first aperture, atomizing the first fuel in the first air passage, delivering a second fuel to a second air passage, filming the second fuel along a film surface in the second air passage to create a fuel film, and shearing the fuel film between an air traversing the first air passage and an air traversing the second air passage.

A feature of the present application includes swirling the air traversing the first air passage upstream of the atomizing.

Another feature of the present application includes imparting a rotational flow component to the second fuel.

Yet another feature of the present application provides wherein the imparting occurs upstream of the second air passage.

Yet still another feature of the present application includes combusting the first fuel and the second fuel in a combustor of a gas turbine engine.

Still yet another feature of the present application includes wetting a surface of the first air passage as a result of the providing a first fuel to a first air passage, the wetting including forming a film of fuel on the surface.

Another feature of the present application includes swirling air through a third air passage, and conveying the film of fuel to a convergence of the air traversing the first air passage the air traversing the third air passage.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a gas turbine engine having a fuel injector including a first fuel circuit for delivering fuel to a first air passage and a second fuel circuit for delivering fuel to a second air passage, the first air passage adjacent to the second air passage, the first fuel circuit structured to deliver fuel transverse to an airflow passing through the first air passage and the second fuel circuit including a fuel filmer structured to deliver fuel to a shear region of the fuel injector defined by the airflow from the first air passage and an airflow from the second air passage, wherein the second fuel circuit includes an opening in a radially outer wall of the second air passage that is structured to deliver fuel to a filming surface of the second air passage, the second fuel circuit including a fuel swirler upstream of the opening, wherein the first air passage is located radially outward of the second air passage, and wherein the first fuel circuit includes a plain jet injector, and the fuel injector is operable to produce a film of fuel on a surface of the first air passage opposite the plain jet injector.

2. The apparatus of claim 1, wherein a side of the first air passage that includes a discharge opening of the plain jet injector extends to the shear region of the fuel injector, the shear region defined by a convergence of the first air passage and the second air passage.

3. The apparatus of claim 2, wherein the first air passage includes a first air swirler and the second air passage includes a second air swirler.

4. The apparatus of claim 3, which further includes a third air passage having a third air swirler located radially outward of the second air swirler, the third air passage merging with the first air passage downstream of the plain jet injector.

5. The apparatus of claim 2, wherein the first fuel circuit is a main fuel circuit and the second fuel circuit is a pilot circuit.

6. The apparatus of claim 5, wherein the surface of the first air passage terminating at a convergence of the first air passage and a third air passage having a third air swirler.

7. The apparatus of claim 1, wherein the plain jet injector is structured to deliver fuel in a direction away from the second fuel circuit and toward a third air passage that includes a third air swirler.

8. An apparatus comprising:

a gas turbine engine fuel injector including a plain jet injector structured to deliver fuel transverse to a first air passage, the plain jet injector structured to produce a film of fuel on a surface of the first air passage opposite the plain jet injector, a fuel filmer disposed in a second air passage, the fuel filmer structured to deliver fuel to a filming surface of the second air passage through an opening, the filming surface and the opening located in a radially outer wall of the second air passage, and an air swirler located upstream in the second air passage, the first air passage adjacent the second air passage, the first air passage and the second air passage structured to converge from a radially outer location inward toward a confluence region;

wherein the first air passage is located radially outward of the second air passage; and wherein the fuel filmer is structured to further deliver the fuel from the filming surface to the confluence region of the first air passage and the second air passage.

9. The apparatus of claim 8, wherein the air swirler located upstream in the second air passage is a first swirler structured to impart a swirl to an airstream traversing the second air passage, the apparatus further comprising a second swirler structured to impart a swirl to an airstream traversing the first air passage.

10. The apparatus of claim 9, wherein the plain jet injector is positioned downstream of the first swirler.

11. The apparatus of claim 8, wherein the plain jet injector is operable to deliver a liquid fuel to the surface of the first air passage opposite the plain jet injector to form the film of fuel on the surface of the first air passage.

12. The apparatus of claim 11, which further includes a third air passage having a third air swirler, the liquid fuel conveyed to a convergence of the first air passage and the third air passage.

13. The apparatus of claim 12, wherein the gas turbine engine fuel injector is coupled with a gas turbine engine and is structured to deliver fuel to a combustor of the gas turbine engine.

14. The apparatus of claim 12, which further includes a main fuel circuit having the plain jet injector and a pilot fuel circuit having the fuel filmer.

15. An apparatus comprising:

a gas turbine engine having a combustor and a fuel injector structured to deliver fuel to the combustor, the fuel injector having:

a first fuel opening operable to deliver fuel to a first air passage, the first fuel opening opposite a filming surface of the first air passage; and a second fuel opening operable to deliver fuel to a filming surface of a second air passage, wherein the second fuel opening and the filming surface of the second air passage are located in a radially outer wall of the second air passage, wherein the first air passage is located radially outward of the second air passage, and an air swirler is located in the second air passage upstream of the second fuel opening; and wherein the first air passage and the second air passage are configured to merge at a shear region for mixing fuel delivered through the first fuel opening with fuel delivered through the second fuel opening, wherein the shear region is upstream of a throat of the fuel injector.

16. The apparatus of claim 15, the fuel injector further including a third air passage, wherein the first air passage and third air passage merge at an intermixing region for intermixing a fuel film in the first air passage with an air traversing the third air passage.

17. A method comprising:

providing a first fuel to a first air passage through a first aperture;

atomizing the first fuel in the first air passage;

wetting a surface of the first air passage opposite the first aperture as a result of the providing the first fuel to the first air passage, wherein the wetting the surface of the first air passage comprising forming a film of fuel on the surface of the first air passage;

delivering a second fuel to a second air passage through an opening located in a radially outer wall of the second air passage, the first air passage located radially outward of the second air passage;

filming the second fuel along a film surface in the second air passage to create a fuel film;

swirling an air traversing the second air passage before the air reaches the opening located in the radially outer wall of the second air passage;

shearing the fuel film created by the filming the second fuel along the film surface in the second air passage between an air traversing the first air passage and the air traversing the second air passage; and combusting the first fuel and the second fuel in a combustor of a gas turbine engine.

18. The method of claim 17, which further includes swirling the air traversing the first air passage at a location upstream of the location of the atomizing.

19. The method of claim 18, which further includes imparting a rotational flow component to the second fuel.

20. The method of claim 19, wherein the imparting the rotational flow component occurs upstream of the second air passage.

21. The method of claim 17, which further includes:

swirling air through a third air passage; and conveying the film of fuel to a convergence of the air traversing the first air passage and the air traversing the third air passage.

* * * * *